US005769045A

United States Patent [19]

Edwards et al.

[11] Patent Number: 5,769,045

[45] Date of Patent: Jun. 23, 1998

[54] MODULAR AIR INDUCTION SYSTEM WITH ISOLATED THROTTLE BODY

[75] Inventors: James R. Edwards, Royal Oak; Thomas M. Knowles, Sterling Heights, both of Mich.

[73] Assignee: Chrysler Corporation, Auburn Hills, Mich.

[21] Appl. No.: 847,090

[22] Filed: May 1, 1997

[51] Int. Cl.[6] ..... F02M 35/10

[52] U.S. Cl. ..... 123/184.61

[58] Field of Search ..... 123/184.21, 184.61, 123/184.53, 184.55, 184.56

[56] References Cited

U.S. PATENT DOCUMENTS

| | | | |
|---|---|---|---|
| 3,949,716 | 4/1976 | Liu . | |
| 4,628,873 | 12/1986 | Bitter | 123/184.42 |
| 4,867,110 | 9/1989 | Distelrath | 123/184.61 |
| 4,889,081 | 12/1989 | Ozaki | 123/184.53 |
| 4,890,586 | 1/1990 | Fujii et al. | 123/184.55 |
| 4,901,681 | 2/1990 | Pozniak et al. | 123/184.61 |
| 5,158,045 | 10/1992 | Arthur et al. . | |
| 5,170,754 | 12/1992 | Urabe | 123/184.31 |
| 5,181,491 | 1/1993 | Izumi et al. . | |
| 5,322,038 | 6/1994 | Urabe et al. . | |
| 5,447,128 | 9/1995 | Spinelli | 123/814.53 |
| 5,474,039 | 12/1995 | Doragrip | 123/184.55 |
| 5,477,819 | 12/1995 | Kopec | 123/184.61 |
| 5,651,338 | 7/1997 | Pacheco et al. | 123/184.55 |
| 5,664,533 | 9/1997 | Nakayama et al. | 123/184.61 |

FOREIGN PATENT DOCUMENTS

| | | | |
|---|---|---|---|
| 3245190 | 6/1984 | Germany | 123/184.53 |
| 58-204950 | 11/1993 | Japan | 123/184.61 |

*Primary Examiner*—David A. Okonsky
*Attorney, Agent, or Firm*—Kenneth H. MacLean

[57] ABSTRACT

An air induction system for an internal combustion engine featuring a throttle body and air cleaner assembly vibrationally isolated from the engine by a resilient air transmitting zip tube interconnecting the throttle body with the engine air intake manifold. The zip tube flexes to isolate the throttle body from engine vibrations and oscillations thereby eliminating a cause of throttle body fractures or looseness from its mounting. Furthermore, with such isolation, the throttle body can be readily formed from plastics and provide long service life. With the throttle body isolated, engine generated throttle pedal vibration is eliminated. Additionally with the remote location, throttle body and throttle plate coking and icing from recirculating exhaust gases is obviated. The throttle body and air cleaner assembly is supplied as a unit to augment vehicle assembly.

7 Claims, 4 Drawing Sheets

MODULAR AIR INDUCTION SYSTEM WITH ISOLATED THROTTLE BODY

FIELD OF THE INVENTION

This invention relates to new and improved air induction systems for internal combustion engines featuring a throttle body supported remotely from the engine by an air cleaner unit and pneumatically connected to the engine air intake manifold by a resilient zip tube that flexes in response to engine vibrations and oscillations to isolate the throttle body and the air cleaner unit from the engine.

BACKGROUND OF THE INVENTION

Prior to the present invention various throttle body designs and air cleaner arrangements have been employed in air induction systems for internal combustion engines. In U.S. Pat. No. 5,158,045 to R. Arthur et al, a throttle body is designed with telescopic parts so that it can be inserted into the engine air induction system and then telescopically expanded to operatively connect an air cleaner to the engine intake manifold. In U.S. Pat. No. 5,181,491 to Izumi et al, an air cleaner is secured to the upstream end of a throttle body which in turn is secured at its output directly to the intake manifold of an internal combustion engine. The U.S. Pat. No. 5,322,0383 to Urabe et al discloses throttle bodies having their intakes connected to resilient air inlet ducts and their outlets rigidly secured to the engine intake manifold construction. The throttle bodies of these prior constructions are subject to high loads from engine vibrations and oscillations and may become loose from their mounts or suffer fractures or other damage.

In developmental programs throttle bodies and air cleaners of engineering plastic materials providing lighter and more economical air induction systems have also been mounted to intake manifolds. These structures were however met with limited success since they also experienced mounting looseness as well as stress fractures and breakage from oscillatory and vibratory energy directed thereto from engine oscillations and vibrations occurring during vehicle operations.

Furthermore, throttle bodies mounted on intake manifolds had reduced performance in many cases since their interior wall surfaces and valve plates were coated with carbon from unburnt hydrocarbons of recycled exhaust gas. This was primarily due to their operating position close to the EGR return leading into the intake manifold of the engine. In extremely cold environments, (e.g. +5 to −20 degrees F.), these components were also subject to icing which detracted from their operation.

SUMMARY OF THE INVENTION

In the present invention, the throttle body is preferably molded or otherwise formed from an engineering plastics material, such as fiberglass impregnated thermoplastics, and is uniquely integrated into the air induction system of the internal combustion engine at a point remote and vibrationally isolated from the engine. More particularly, the throttle body is secured to an air cleaner to form an assembly or sub-assembly shipped to the vehicle assembly facility to facilitate vehicle build up.

With this system, the throttle body is located and securely attached at a position remote from the intake manifold assembly while being pneumatically connected to the manifold and its runners leading to the combustion chambers of the engine. This pneumatic connection is achieved with a zip tube that vibrationally isolates the throttle body from the engine and the intake manifold so that the throttle body is not subjected to high engine vibrational loads that often leads to throttle body mounting looseness and fracture.

More particularly, the zip tube is a generally cylindrical thin walled unit of a suitable elastomer having a plurality accordion-like convolutions that provide a flexible connection between the engine and an air filtering and flow controlling assembly provided by the air cleaner—throttle body unit. With the zip tube flexing in response to vibratory or oscillatory energy generated by engine operation, the throttle body and the air filter housing and air filter therein are isolated therefrom. With this isolation throttle bodies and other associated components can be made with reduced mass and from economical materials, such as engineering plastics and accordingly can be effectively used with long service life in induction systems for internal combustion engines.

Additionally, the new and improved modular air induction system of this invention requires fewer components, such as prior support bracketry for large mass throttle bodies. Also, throttle pedal vibration or "buzz" from engine operation is substantially eliminated. Furthermore, with the remote location of the throttle body, there is a material reduction or elimination of throttle body coking as well as water intrusion in the throttle mounted components such as the throttle plate position sensor.

DETAILED DESCRIPTION OF THE DRAWINGS

Figure 1:
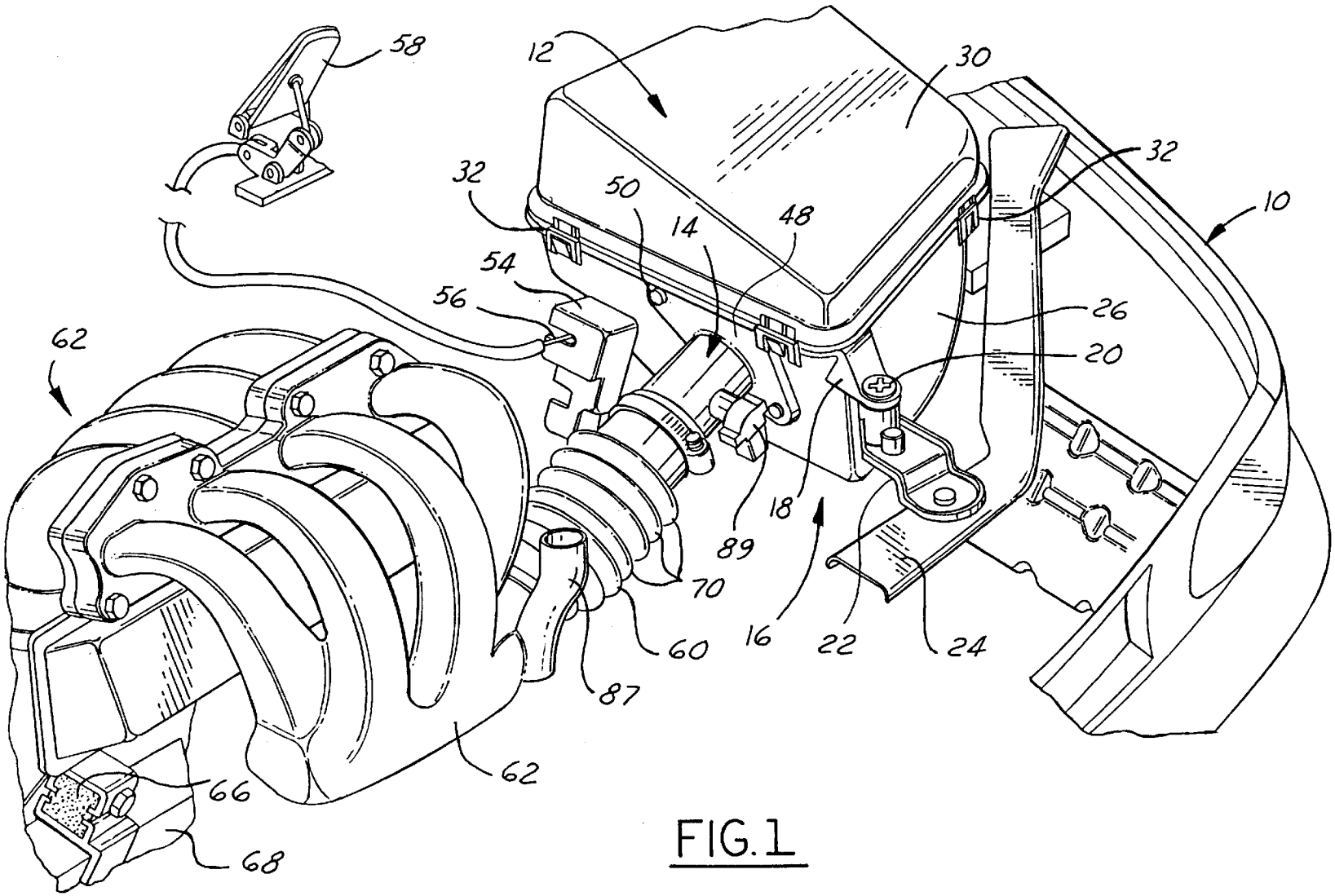
FIG. 1 is a pictorial and diagrammatic view of an internal combustion engine and an associated air induction system within an engine compartment of an automotive vehicle.
Figure 2:
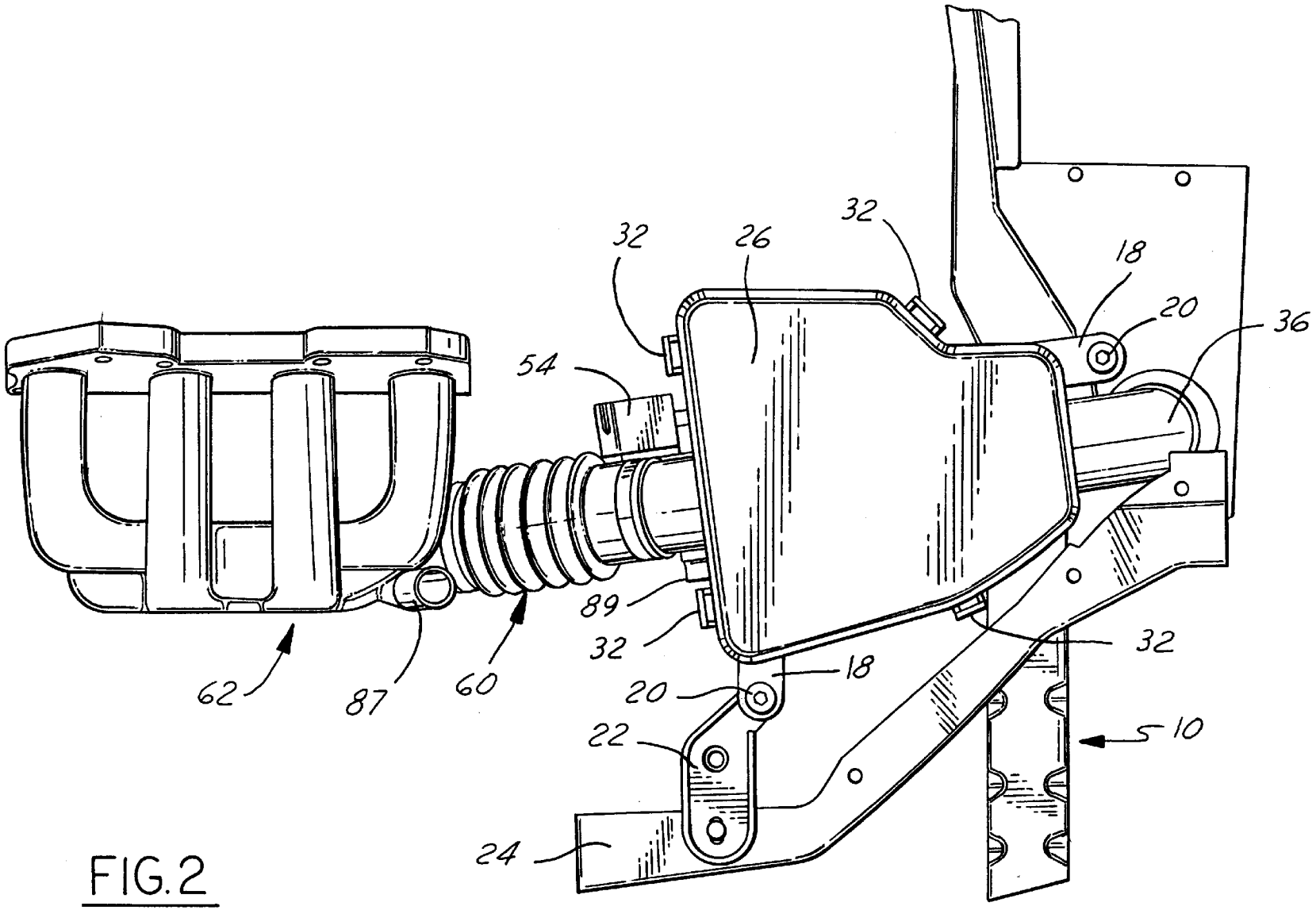
FIG. 2 is a top view of the air cleaner, throttle body sub-assembly and a flexible zip tube connected to the engine manifold of FIG. 1.

Turning now in greater detail to the drawings, there is shown in FIG. 1 a portion of an internal combustion engine for powering an automotive vehicle 10 and having an intake air cleaner enclosure 12 and an associated throttle body 14. The enclosure unit 12 and throttle body 14 are unitized into an air filtering and flow controlling assembly 16. This assembly 16 has outwardly extending mounting projections 18 (only one shown) integral with the air cleaner unit. The projection 18 is adapted to be secured by a fastener 20 to a suitable support structure such as bracket 22 which is fastened to a radiator support cross member 24 fixed within the vehicle 10.

Figure 3:
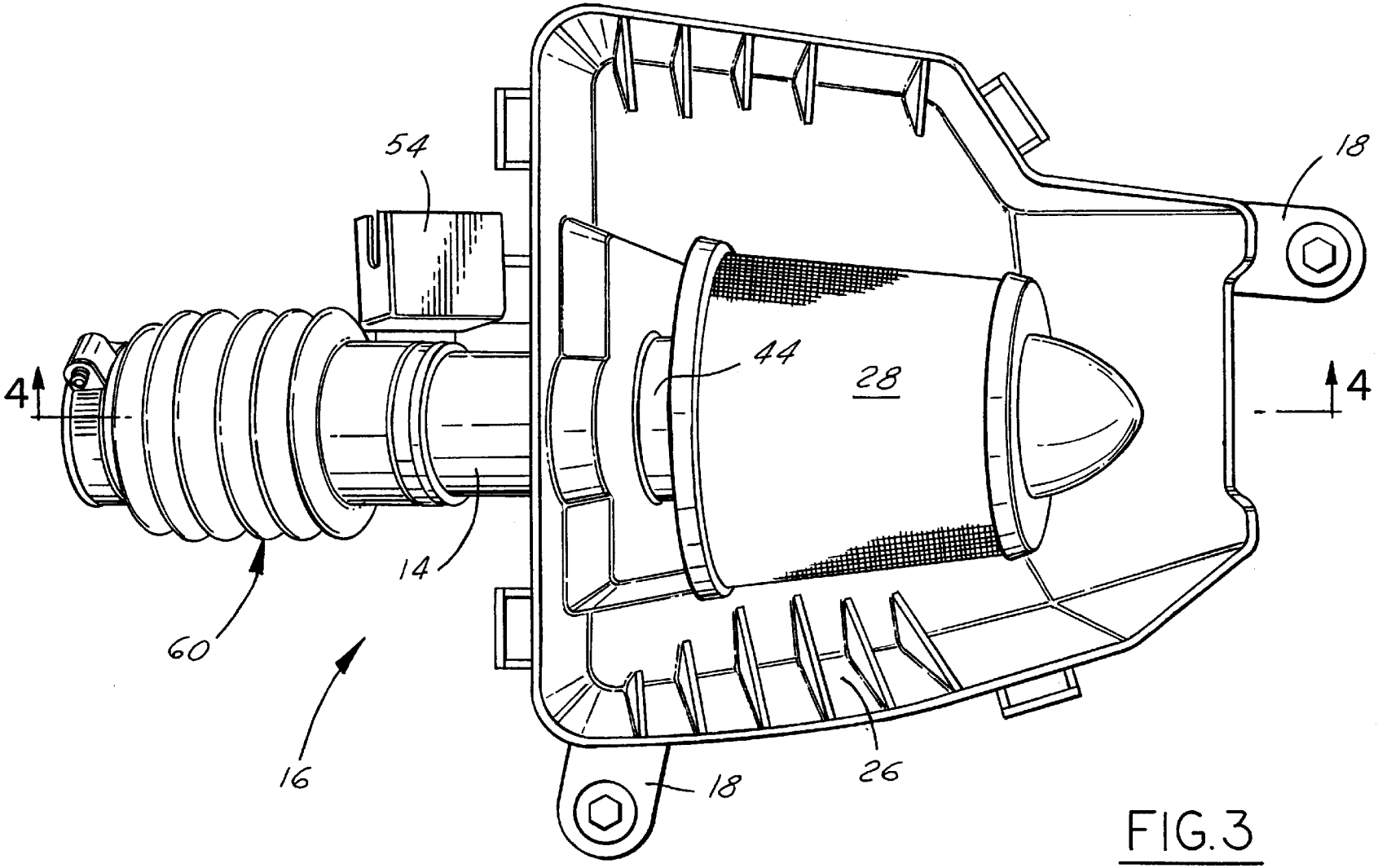
FIG. 3 is an enlarged top view similar to FIG. 2 with parts removed to show interior portions of the throttle body—air cleaner unit prior to assembly with the engine manifold.

The air cleaner enclosure unit 12 includes a shell-like housing including a lower portion 26 formed with the mounting projection 18 as seen in FIG. 1. Referring to FIG. 3, a cartridge type air filter 28 member is operatively supported within the housing. The housing of the air cleaner unit 12 further has an upper cover portion 30 which is releasible secured to the lower housing portion 26 by over-center acting buckle attachments 32 or other suitable fasteners.

Figure 4:
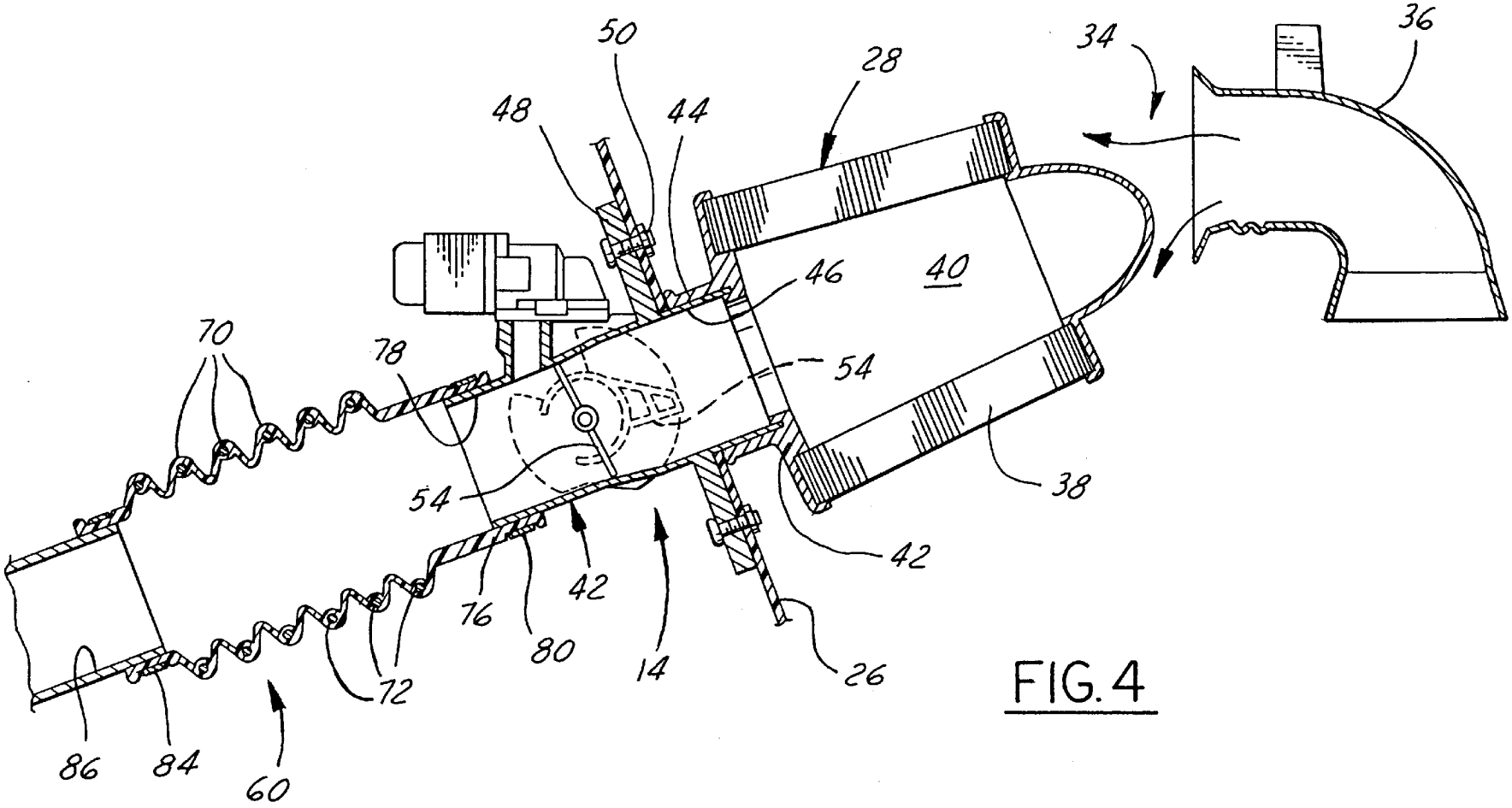
FIG. 4 is a sectional view of the air cleaner throttle body—air cleaner unit and the zip tube extending to the engine manifold and taken generally along sight lines 4—4 of FIG. 3.

As seen in FIG. 4, the air filter 28 receives a flow of air 34 exiting from an air intake pipe 36. The intake pipe 36 leads into the housing enclosure 12. Air flows through the filtering media 38 of the conically shaped filter and passage of foreign particles carried with the air is inhibited into the inner chamber 40 of the filter.

The air filter 28 further has an inboard end 42 formed with a cylindrical support neck 44 that telescopically receives a cylindrically shaped air entrance end portion 46 of the throttle body 14 which extends axially from the main body portion. As best shown in FIGS. 1 and 4, the throttle body has a mounting plate 48 secured by threaded fasteners 50 to the wall of the lower portion of the air cleaner enclosure housing 26. With this arrangement, the air filter 28 can be readily removed from the throttle body after the upper portion 30 of the enclosure unit is separated from the lower portion 26. The throttle body 14 has an annular disk-like throttle plate 52 mounted therein for pivotal movements as a shaft is rotated. The shaft of the throttle plate 52 is operatively connected to an external throttle lever assembly 54 that in turn is operatively connected by a cable 56 to a throttle or accelerator pedal 58 as is diagrammatically shown in FIG. 1. The throttle plate 52 is selectively positioned by the vehicle operator as the accelerator pedal 58 is positioned by the operator's foot to control the flow of air to the engine. Specifically, the air flows from the throttle body 14 to the engine's intake manifold 62 through a special resilient zip tube 60. As is conventionally provided, the engine is mounted on resilient engine mounts 66 (only one shown in FIG. 1). The engine mounts allow the engine to oscillate and vibrate relative to the vehicle frame during engine operation. Normally, these vibrations are transmitted to the throttle body and hence to the vehicle operator through the accelerator pedal.

In contrast to conventional engine arrangements, the subject throttle body and the air cleaner housing are remotely supported relative to the engine for significantly reducing the adverse transfer of vibratory energy from the engine to the throttle body, especially at high loads. Specifically, air is transmitted through the resilient zip tube member 60 which operatively connects the outlet portion of the throttle body 14 to the engine intake manifold 62. The zip tube 60 will flex to accommodate a significant full range of engine motion on its mounts and vibrations are absorbed.

The zip tube 60 is a generally cylindrical and elongated thin-walled flexible member formed from a suitable silicon elastomer or other suitable resilient material. As best shown in FIG. 3, the zip tube 60 is shaped like a bellows with a plurality of convolutions 70 formed in its midportion. Each convolution has an annular hoop 72 of sufficiently rigid elastomeric material which maintains the tubular shape of the zip tube, particularly under engine vacuum. Thus, radially inward collapse of the zip tube is prevented for maintaining the capacity to transmit air into the intake manifold 62. Helical formed or other zip tube configurations are also suitable as long as air flow capacity is maintained and the tube's isolation capacity is maintained.

The zip tube 60 has a cylindrical inlet end 76, which receives the cylindrical discharge end 78 of the throttle body 14. A circular hose clamp 80 is tightened to secure the zip tube to the discharge end throttle body 14 in an air tight manner.

The cylindrical outlet end 82 of the zip tube 60 is similarly secured by hose clamp 84 to an annular air inlet 86 of the intake manifold 62. The air inlet 86 is located adjacent to another inlet 87 to the manifold which is part of the engine exhaust gas recirculation system (EGR) the other portions of which are not shown. The inlet 87 conducts a portion of the exhaust gasses into the manifold for delivery into the combustion chambers of the engine. A portion of this exhaust gas consists of unburned hydrocarbons.

Accordingly, the throttle body and its throttle plate position sensor 89 (shown in FIG. 1) are remotely located from the intake manifold 62 and the EGR and are not subjected to water or other contaminates from exhaust return gas.

Engine operation causes the engine block to oscillate on the mounts. The air confining walls of the zip tube flexes in accordion-like fashion to accommodate the full range of engine motions so that vibratory energy is not transmitted to the throttle body and air cleaner. Resultantly, the throttle body is not subject to engine vibration and has long service life. The air cleaner unit 12 is similarly isolated and protected.

In the preferred embodiment of the present invention, the throttle body 14 is made from a suitable engineering plastics material which is secured to the housing of the air cleaner unit 12 that also can be molded or otherwise formed from suitable plastic or elastomeric material. The throttle body 14 and air cleaner unit 12 are preferably combined as a fixed air filtering and flow controlling assembly 16 which can be built up as a modular package or sub-assembly which is easily shipped and handled to augment assembly of the vehicle. If desired, the flexible zip tube may be included as part of this sub-assembly.

While preferred embodiments and manufacturing methods of the invention have been shown and described, other embodiments will now become apparent to those skilled in the art. Accordingly, this invention is not to be limited to that which is shown and described but by the following claims.

What is claimed is:

1. A modular air induction system for an internal combustion engine of an automotive vehicle operatively supported by resilient engine mounts to a first fixed support within the vehicle to accommodate engine oscillation and vibrations, and separate from a second fixed support therein, comprising an air intake manifold for direct connection to said engine, an air cleaner for direct mounting to the second support for filtering air for mixing with fuel for said engine and subsequent combustion within said engine, a throttle body operatively mounted to said air cleaner to receive filtered air from said air cleaner, an elongated zip tube operatively and directly connecting said throttle body to said air intake manifold to provide an unobstructed air flow passage for conducting air from said throttle body to said air intake manifold, said zip tube being defined by a confining curved wall of thin resilient material for vibrationally isolating said throttle body from said air intake manifold and from said engine.

2. The modular air induction system of claim 1, wherein said vibration isolating zip tube is a thin-walled generally cylindrical member of plastics material having a plurality of accordion-like convolutions therein to provide for tube flexing in response to oscillations and vibrations of said engine on said mounts.

3. The modular air induction system of claim 1, wherein said air cleaner unit has an air filtering cartridge operatively supported within said air cleaner by said throttle body, said cartridge having an air discharge neck, said throttle body having an air inlet operatively received within said neck to provide the support for said cartridge and having an outlet, said zip tube being an elongated flexible bellows member having an inlet directly secured to said air throttle body outlet and having an outlet directly secured to said air intake manifold of said engine.

4. The modular air induction system of claim 1, wherein said throttle body unit is a molded plastics unit mounted to said air cleaner and isolated from said engine by said zip tube.

5. A modular air cleaner and throttle body assembly of an air induction system for operative connection to the air intake manifold of an internal combustion engine for an automotive vehicle comprising an air cleaner housing of plastics material, an air filtering cartridge operatively supported therein, an air inlet for directing air into said housing, said cartridge having an air outlet for directing filtered air outwardly from said cartridge and said air cleaner housing, a throttle body housing of plastics material rigidly secured to said air cleaner housing and operatively connected with said air outlet of said cartridge to provide for the direct support of said cartridge within said housing, a throttle plate operatively adjustably mounted in said throttle body housing to control the air flow from said cartridge, and a flexible bellows-like zip tube of resilient material providing for unobstructed air flow between said throttle body and said air intake manifold and for the isolation of said throttle body from vibrations of said engine.

6. An air cleaner and throttle body assembly for an air induction system directing air to an internal combustion engine of an automotive vehicle through the air intake manifold thereof comprising an air cleaner housing, an air filtering cartridge operatively supported within said housing, an air inlet for directing air into said housing, said cartridge having an air outlet for directing filtered air from said housing, a throttle body housing rigidly secured to said air cleaner housing and operatively and directly connected with said air outlet of said cartridge to fully support said cartridge within said housing, a throttle plate operatively adjustably mounted in said throttle body housing to control the air flow from said air cleaner housing and an elongated, thin walled flexible member having a plurality of convolution defining a resilient air conducting zip tube for directly and operatively connecting said throttle body to said air intake manifold of said engine and to provide an unobstructed air flow therebetween and for vibrationally isolating said throttle body from said engine.

7. The assembly of claim 6, wherein said air cleaner housing and said throttle body are molded from plastics material and said air cleaner housing has support brackets integral therewith for supporting the air cleaner housing and throttle body within the vehicle.

* * * * *